US008079378B1

(12) United States Patent
Derlinga

(10) Patent No.: US 8,079,378 B1
(45) Date of Patent: Dec. 20, 2011

(54) COMBINATION UMBRELLA AND GAZEBO

(76) Inventor: Thomas S Derlinga, East Granby, CT (US)

( * ) Notice: Subject to any disclaimer, the term of this patent is extended or adjusted under 35 U.S.C. 154(b) by 73 days.

(21) Appl. No.: 12/701,135

(22) Filed: Feb. 5, 2010

Related U.S. Application Data

(60) Provisional application No. 61/150,843, filed on Feb. 9, 2009.

(51) Int. Cl.
*A45B 25/18* (2006.01)
*E04H 15/28* (2006.01)

(52) U.S. Cl. ..... 135/33.2; 135/16; 135/98

(58) Field of Classification Search ..... 135/33.2, 135/16, 98, 117
See application file for complete search history.

(56) References Cited

U.S. PATENT DOCUMENTS

| | | | | |
|---|---|---|---|---|
| 2,502,984 | A * | 4/1950 | Parmenter | 135/33.7 |
| 2,546,228 | A * | 3/1951 | Martini | 135/33.71 |
| 4,022,233 | A * | 5/1977 | Grundman | 224/187 |
| 4,807,655 | A * | 2/1989 | Robertson | 135/22 |
| 5,740,822 | A * | 4/1998 | Einck | 135/16 |
| 5,806,547 | A | 9/1998 | Derlinga | 135/33.2 |
| 6,170,497 | B1 * | 1/2001 | Ma | 135/20.3 |
| 6,698,440 | B2 * | 3/2004 | Beyer et al. | 135/25.41 |
| 2002/0108645 | A1 * | 8/2002 | Beyer et al. | 135/33.2 |

FOREIGN PATENT DOCUMENTS

DE 4037087 A1 * 5/1992

* cited by examiner

*Primary Examiner* — David Dunn
*Assistant Examiner* — Danielle Jackson

(57) ABSTRACT

An improved combination umbrella and gazebo is provided which protects the user from adverse weather and insects.

14 Claims, 5 Drawing Sheets

COMBINATION UMBRELLA AND GAZEBO

CROSS-REFERENCE TO RELATED APPLICATION

This application claims the benefit under 35 U.S.C. §119 (c) of U.S. Provisional Patent Application No. 61/150,843, filed Feb. 9, 2009, titled "Improved Combination Umbrella and Gazebo", which application is incorporated herein in its entirety.

FIELD OF THE INVENTION

The present invention relates to a combination umbrella and gazebo.

BACKGROUND OF THE INVENTION

Combinations of umbrellas and gazebos are known in the art as exemplified by U.S. Pat. No. 5,806,547 (the '547 patent), of which the present applicant is the inventor, which patent is incorporated herein by reference in its entirety. The combination disclosed in the '547 patent includes a frame, a canopy, and side panels made of fine mesh material. The frame includes a center pole having a peak and a base and further includes a plurality of ribs which are pivotably mounted to the peak of the center pole. These ribs extend radially outwardly from the peak and have free distal ends.

The canopy is comprised of a plurality of panels that are sewn together and affixed to the frame. A number of side panels equal to the number of canopy panels are sewn together on their long sides and are attached to the outer circumference of the canopy on their upper short side. The side panels are raised and lowered by means of a screen crank mechanism positioned within and about the center pole of the frame. When the side panels are raised, the combination functions as an umbrella, and the opaque water resistant material of the canopy provides the user with protection against both precipitation and the direct rays of the sun. When lowered, the side panels act as an enclosure, screening out insects and providing the user with a pest free area in which to enjoy the outdoors.

The screen crank mechanism used to raise and lower the side panels is best described by referencing the numbered figures in the '547 patent. As shown in FIGS. 3-5 of the '547 patent and employing the reference numbers used therein, the prior art device employs a cord 84 connected to a snap hook ring 86 within the hollow interior of the center pole 56. A plurality of cords 88 are each attached to a ring 96 positioned within the hollow interior of each rib 60. A plurality of cords 98 are each threaded through the hole in the respective ring 96. One end of each cord 98 passes through a through-bore 67 and is firmly affixed to the top of the rib 60 while the opposite end is threaded through a through-bore 71 on the distal end of the bottom of each rib 60 and is attached to the screened side panels 30. The screened side panels 30 are raised and lowered via the screen crank mechanism 80.

As the crank handle 83 is turned in one direction, the cord 84 winds around the shaft of the crank 82 causing the snap hook ring 86, cords 88, and rings 98 to retract and move downward into the center pole 56. The rings 96 operate as a blocks, putting tension on the plurality of cords 98, pulling the ends attached to the screen side panels 30 into the hollow interior of the ribs 60. The screened side panels 30 affixed to the cords 98 are drawn upward as the cords 98 retract.

Likewise, as the crank handle 83 is turned in the opposite direction, the cord 84 unwinds from the shaft of the crank 82 by virtue of the weights 101 attached to screened side panels 30. As the cords 84 extend, the cords 88 move upward and outward through the hollow interior of the ribs 60. The weights 101 attached to the screened side panels 30 draw the cords 98 out of the hollow interior of the ribs 60 allowing the screened side panels 30 to lower.

While the prior invention proffers a solid design, the narrow cross-section of the umbrella ribs necessitates the use of fine cords. Even with these fine cords, the lack of space within the ribs may result in snagging of both the rings and cords within the rib interior as they are retracted and extended. This snagging results in asymmetric extension of the side panels, allowing insects to enter the screened area and defeating the purpose of the mesh gazebo. The narrow rib cross-section and limited access to the area also make repair of the ring and cord assembly difficult. Additionally, whenever a ring and cord assembly repair is made, the repairer must take great care to properly position the components within the rib. If the ring is not placed in the exact location of original manufacture, the affected side panel will not extend and retract uniformly with the remaining panels. In practice, it has been found difficult to effect such a careful positioning. The present invention seeks to simplify the crank mechanism in order to reduce the problems of the prior art.

SUMMARY OF THE INVENTION

The present invention provides a combination umbrella and gazebo that avoids the disadvantages of the prior art by reducing the number of rings, cords and through-bores employed by the previous design. Rather than utilizing a number of expensive, polytetrafluoroethene-coated rings positioned within the smaller interior of the rib, the present invention uses a single cable block within the larger hollow cross-section of the center pole. A crank cable positioned within the center pole is attached to the cable block at one end while the opposite end is affixed to the shaft of a crank mechanism. Screen cables are secured at one end to the center pole between the cable block and the peak of the center pole while the opposite end of each screen cable passes down through the cable block, up through the center pole, and out through the length of the respective rib where it is attached to the respective side panel. This arrangement reduces snags and eliminates the repair problems noted above. The term "cable block" includes a solid ring, a pulley, or similar structure through which the force of the crank cable is transmitted to the screen cables in substantially a 2:1 ratio.

Placement of one cable block within the larger hollow area of the center pole permits cables of greater diameter to be used. These larger cables are more resistant to wear, reducing breakage and the need for repair. The larger cross-section of the center pole also offers greater access to the screen crank mechanism, simplifying manufacture and any needed repair. In the event that a screen crank mechanism repair is required, the positioning problem noted above is substantially diminished. A replacement screen cable of the appropriate length may be readily passed through the hole in the cable block and be attached to the center pole to effect uniform extension and retraction of the side panels.

The construction and method of operation of the present invention, together with additional objects and advantages thereof, will be best understood from the drawings and detailed description of the invention that follow.

LIST OF REFERENCE NUMERALS UTILIZED IN THE FIGURES

Figure 1:
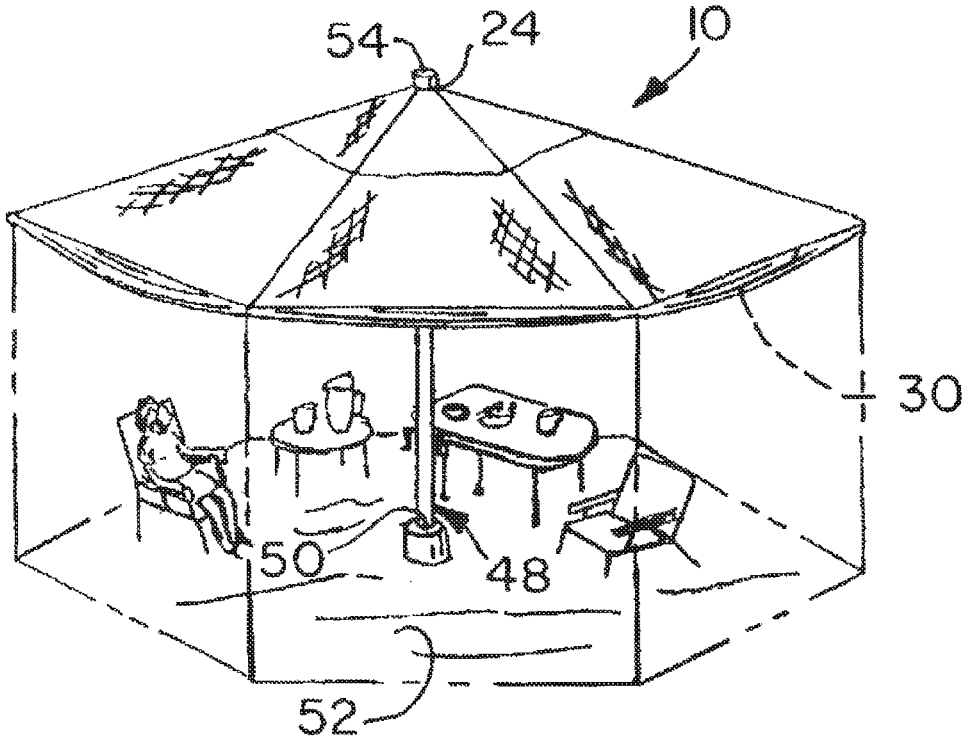
FIG. 1: Diagrammatic view of the present invention in use.

10 combination umbrella and gazebo of the present invention
16 canopy
18 canopy panels of canopy 16
20 sides of canopy panels 18
22 canopy seams of sides 20
24 apexes of canopy panels 18
30 screened side panels of fine mesh material
32 long sides of panels 30
34 edge seams of long sides 32
35 entrance side panel of side panels 30
36 short side of each side panel 30
48 frame
50 bottom of frame 48
52 staging surface
54 peak of frame 48
56 center pole of frame 48
58 collar of frame 48
59 umbrella stop of frame 48
60 ribs of frame 48
62 proximal ends of ribs 60
64 free distal ends of ribs 60
66 pivot arms of frame 48
68 proximal ends of pivot arms 66 of frame 48
70 distal ends of pivot arms 66 of frame 48
72 first crank assembly of frame 48
73 umbrella pulley
74 shaft of first crank assembly 72
75 pulley slot of center pole 56
76 handle of first crank assembly 72
78 first crank cable
80 second crank assembly of frame 48
82 shaft of second crank assembly 80
83 handle of second crank assembly 80
84 second crank cable
101 weights of side panels 30
103 center screen cable guides
104 diametrically opposed center screen cable guides
105 proximal screen cable guide
106 distal screen cable guide
107 anchor bolt
108 cable block
109 screen cable
110 pole end of screen cable 109
111 screen end of screen cable 109

DETAILED DESCRIPTION OF THE INVENTION

Figure 2:
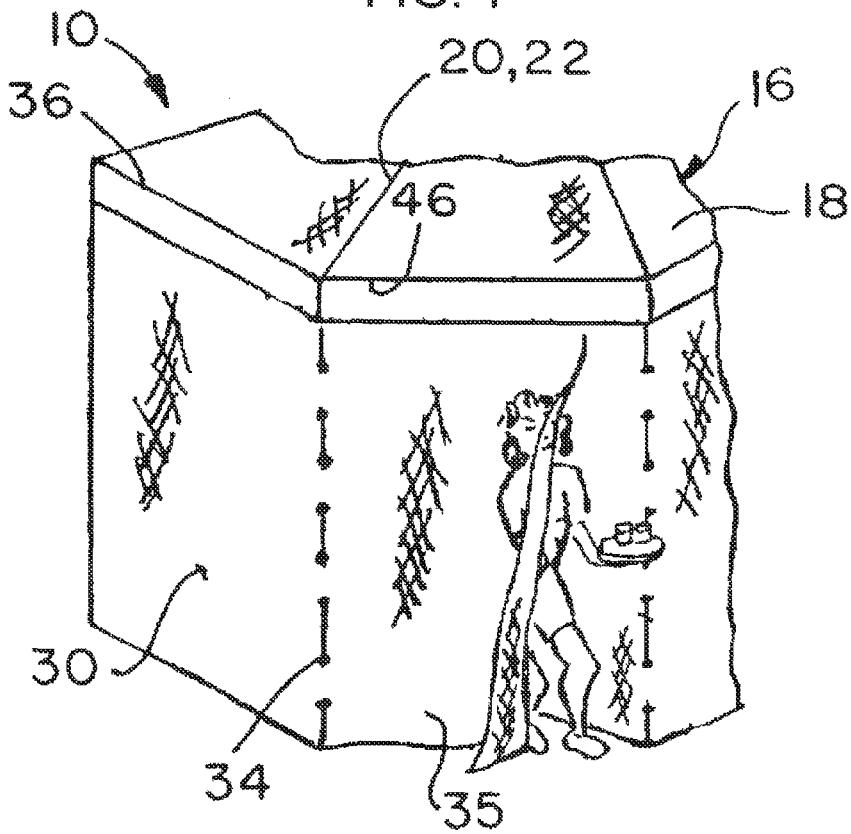
FIG. 2: Diagrammatic view of the present invention showing mesh side panels in use.
Figure 3:
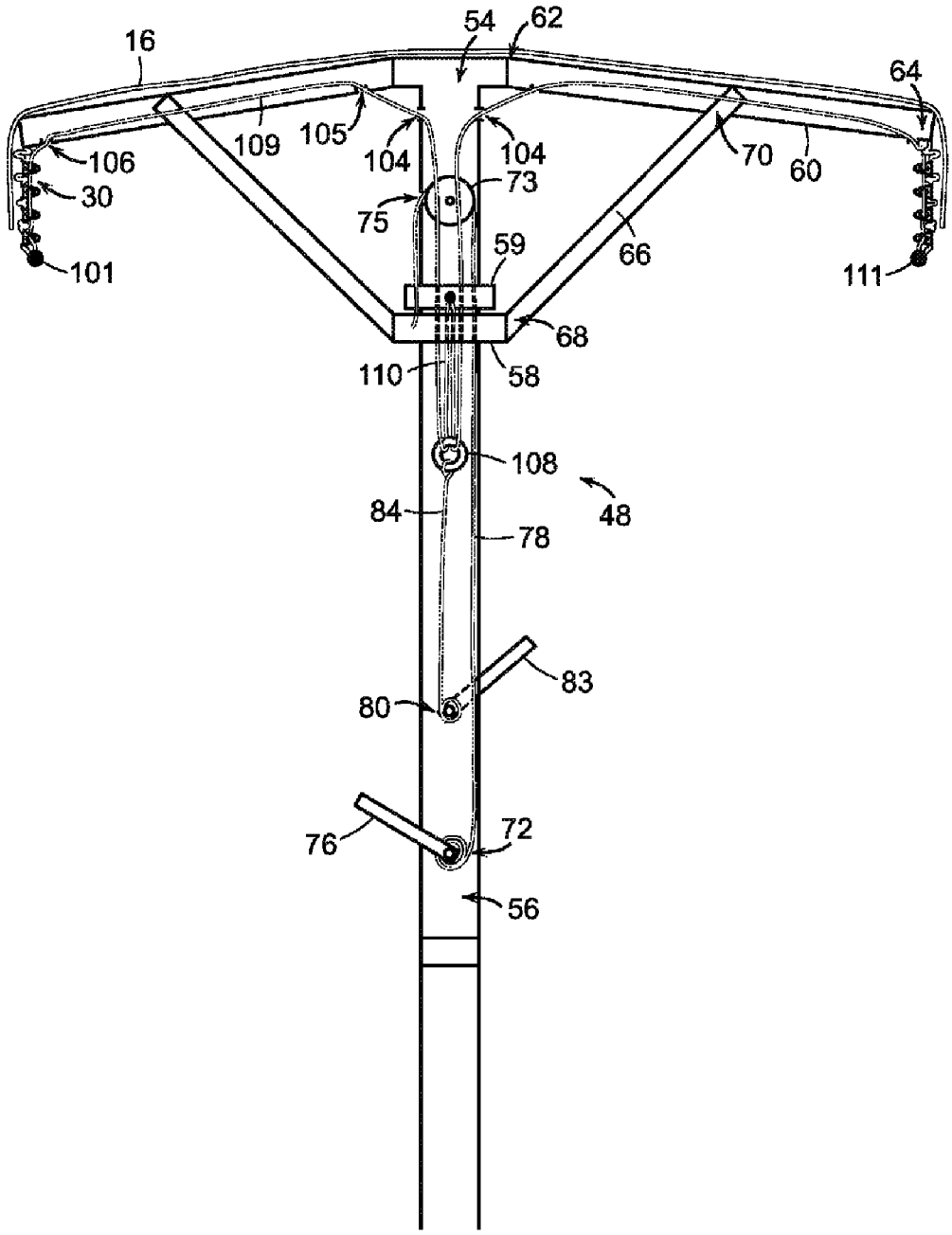
FIG. 3: Frame assembly of the present invention with the mesh side panels raised.
Figure 4:
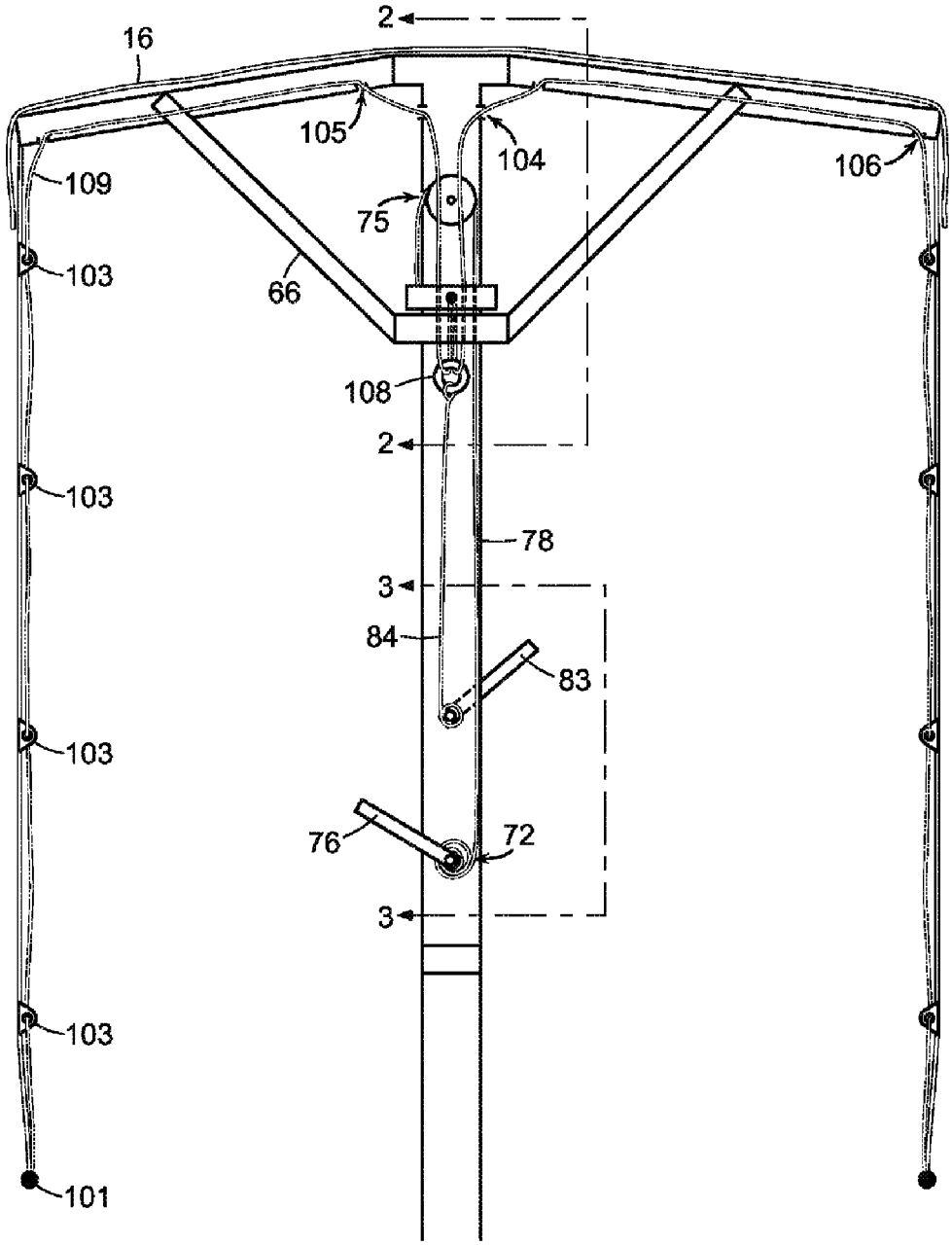
FIG. 4: Frame assembly of the present invention with the mesh side panels lowered.
Figure 5:
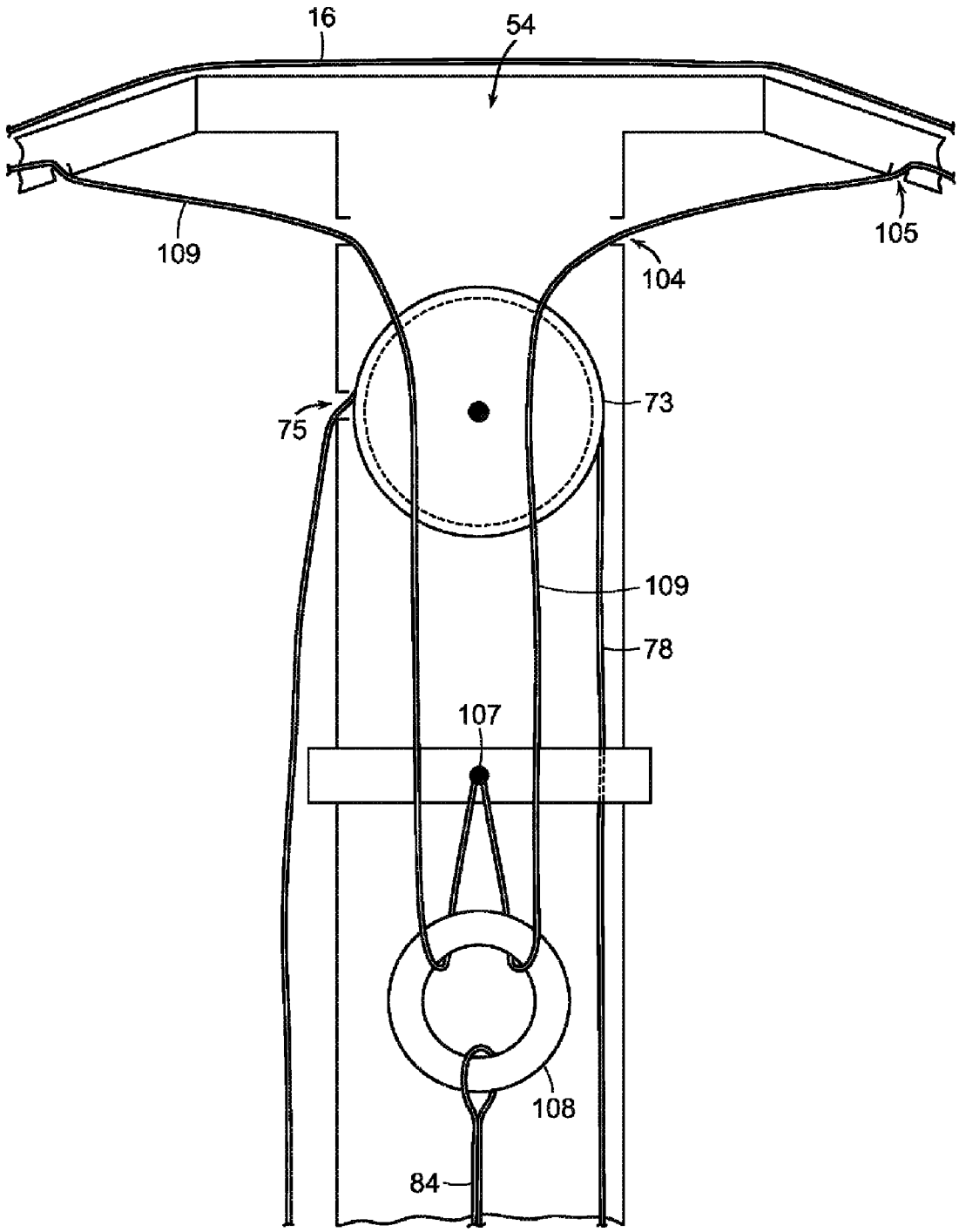
FIG. 5: View of center pole taken on line 2-2 of FIG. 4.
Figure 6A:
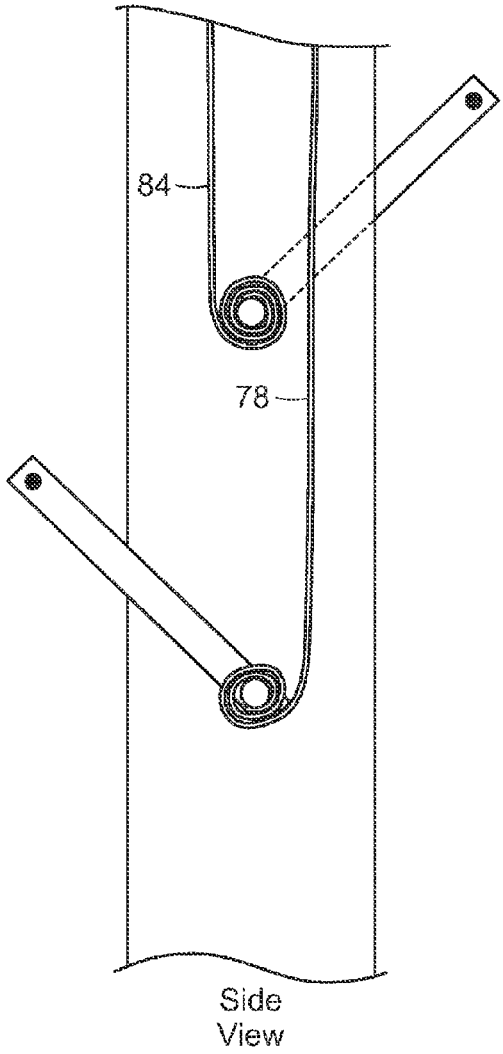
FIGS. 6A and 6B: Side view and front view of center pole taken on line 3-3 of FIG. 4.
Figure 6B:
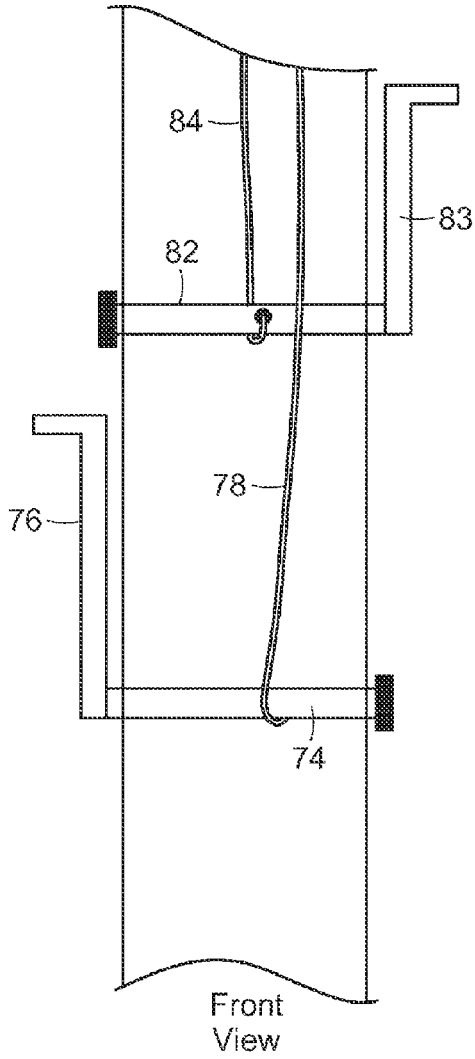

FIGS. 1 and 2 illustrate the present invention in use. The combination umbrella and gazebo 10 has a canopy 16 having a plurality of canopy panels 18 made of opaque water-resistant material and sewn together at the canopy seams 22 along the sides of the canopy panels 20. The combination also has a plurality of screened side panels 30 made of fine mesh material sewn together on their long sides 34 and affixed to the canopy 16 at their upper short sides 36. The screened side panels 30 may be raised as shown in FIG. 3 or lowered as illustrated in FIG. 4.

The combination umbrella and gazebo 10 includes a frame 48 with a bottom 50 that fits into a standard umbrella base and a peak 54 to which are connected the apexes 24 of the canopy panels 18.

Umbrella Configuration

The configuration of the frame 48 is shown in FIGS. 1-6.

The frame 48 includes a center pole 56 that is tubular, elongated, slender, hollow, and substantially vertically-oriented, the center pole 56 having a peak 54 at its highest point and a bottom 50 at its lowest point. The frame 48 further includes a collar 58 that is longitudinally slideably mounted around the center pole 56. The frame 48 further includes a number of ribs 60 equal to the number of canopy seams 22, the ribs 60 being slender, elongated, hollow, and rectangular-shaped in cross section. The ribs 60 are pivotably mounted to the peak 54 at their proximal ends 62 and extend radially outwardly therefrom along the canopy seams 22 having free distal ends 64.

The frame 48 further includes a number of pivot arms 66 equal to the number of ribs 60, each pivot arm being slender, elongated, hollow, and square-shaped in cross section. The pivot arms 66 are pivotably mounted to the collar 58 at their proximal ends 68 and extend radially outwardly therefrom and have distal ends 70. Each distal end 70 of each pivot arm 66 is pivotably mounted to a respective rib 60 between the proximal end 62 of the respective rib 60 and the distal end 64 of the respective rib 60, so as to allow ribs 60 to extend outwardly when the collar 58 is slideably raised longitudinally along the center pole 56, thus opening the canopy 16, and further allowing the ribs 60 to retract inwardly when the collar 58 is slideably lowered longitudinally along the center pole 56, thus closing the canopy 16.

The frame 48 further includes a pulley 73 that is vertically rotatably mounted within the center pole 56, between the peak 54 and the collar 58. The frame 48 further includes a first crank assembly 72 with a first shaft 74 that extends transversely into the pole 56 of the frame 48, and a first crank handle 76 that is disposed externally to the center pole 56. The frame 48 further includes a first crank cable 78 that is affixed to the first shaft 74 of the first crank assembly 72. The first crank cable 78 then passes longitudinally upwardly through the center pole 56, reeves around the pulley 73, passes through the pulley slot 75, and extends longitudinally downwardly therefrom to the collar 58 where it is affixed thereto. Pulley 73 is within the hollow of and affixed to the center pole 56 above umbrella stop 59, which marks the position of maximum upward travel of the collar 58 when the canopy 16 is fully open. As the first crank assembly 72 is turned in one direction, the first crank cable 78 winds around the first shaft 74 causing the collar 58 to slideably rise longitudinally along the center pole 56, which in turn causes the ribs 60 to extend outwardly thus opening the canopy 16, and as the first crank assembly 72 is turned in the opposite direction, the first crank cable 78 unwinds from the first shaft 74 causing the collar 58 to slideably lower longitudinally along the center pole 56, which in turn causes the ribs 60 to retract inwardly thereby closing the canopy 16.

Gazebo Configuration

The distal end 64 of each rib 60 has a distal screen cable guide 106. In the preferred embodiment, each distal screen cable guide 106 is a through-bore that penetrates the lower surface of the rib 60 allowing access to the hollow portion of the respective rib 60.

The proximal end 62 of each rib 60 has a proximal screen cable guide 105. In the preferred embodiment each proximal screen cable guide 105 is a through-bore that penetrates the lower surface of the rib 60 allowing access to the hollow portion of the respective rib 60. Although the screen cables 109 are described above as within each hollow rib 60, alternative arrangements such as guides running along the outside of the undersurface of each rib 60 can be contemplated.

The frame 48 further includes a number of center screen cable guides 104. The number of center screen cable guides 104 may be equal to the number of ribs 60 or may be half the number of ribs 60. Each center screen cable guide 104 is positioned in center pole 56 below (in the case of a equal number of center screen cable guides) or between (in the case of half the number of center screen cable guides) the point in which each rib 60 is connected to the peak 54, the center screen cable guides 104 being evenly oriented and aligned around the circumference of the center pole 56 and near the peak 54. In the preferred embodiment, each center screen cable guide 104 is a through-bore that penetrates the center pole 56 allowing access to the hollow interior of the center pole 56.

The frame 48 further includes a second crank assembly 80 with a second shaft 82 that extends transversely into the center pole 56, preferably above the first crank assembly 72, and a second crank handle 83 that is disposed externally to the center pole 56. The frame 48 further includes a second crank cable 84 that is affixed at one end to the second shaft 82 of the second crank assembly 80, extends longitudinally upwardly through the center pole 56, and is affixed to a cable block 108 having a hole therein, preferably a transverse hole. In the preferred embodiment, the cable block 108 is a metal ring.

The frame 48 further includes a plurality of screen cables 109, each said cable having a pole end 110 and a screen end 111. The pole end 110 of each screen cable 109 is affixed to the interior of the center pole 56 between the cable block 108 and the peak 54 of the center pole 56. In the preferred embodiment, the pole end 110 of each screen cable 109 is affixed to the umbrella stop 59 with an anchor bolt 107.

The screen end 111 of each screen cable 109 passes through the hole in the cable block 108 and extends toward the peak 54 of the center pole 56. Each screen end 111 exits the center pole 56 through the respective center screen cable guide 104 and into the respective proximal screen cable guide 105 of the rib 60, through the hollow length of the rib 60 and out of the respective distal screen cable guide 106 of the rib 60. The screen end 111 of each screen cable 109 is then threaded through cable guide 103 on the respective screened side panel 30 and is attached to a point on the lower short sides 36 of the screened side panels 30 terminating in a weight 101.

As the second crank handle 83 is turned in one direction, the second crank cable 84 winds around the second shaft 82 causing the cable block 108 to move downward as the second crank cable shortens in length. The cable block 108 operates as a block, putting tension on the plurality of screen cables 109 and pulling them downward into the hollow portion of the center pole 56, which in turn causes the screen cables 109 to retract as they withdraw into each respective rib 60. The screened side panels 30 affixed to the plurality of screen cables 109 fold upwards as they retract.

Likewise, as the second crank handle 83 of the second crank assembly 80 is turned in the opposite direction, the second crank cable 84 unwinds from the second shaft 82, pulled by the weights 101 attached to the screen end 111 of the screen cables 109. As the second crank cable 84 extends, the cable block 108 moves upward, allowing the plurality of screen cables 109 to extend. The screened side panels 30 unfurl as the screen cables 109 lengthen, resulting in full extension of the screened side panels 30.

While the invention has been described in accordance with certain preferred embodiments thereof, those skilled in the art will understand the many modifications and enhancements which can be made thereto without departing from the true scope and spirit of the invention, which is limited only by the claims appended below.

I claim:

1. A combination umbrella and gazebo comprising:

(a) a frame comprising a plurality of ribs having proximal and distal cable guides therein and a hollow center pole having a peak and a plurality of cable guides proximal to the peak;

(b) a canopy affixed to said frame and having a periphery;

(c) a plurality of substantially rectangular screened side panels, each panel having an upper edge, a lower edge and two side edges, each panel being attached by its upper edge to the periphery of said canopy and being attached by its side edges to the adjacent panel; and (d) a crank assembly unit comprising:

(1) a crank attached to said center pole;

(2) a crank cable located within the hollow space of said center pole and having an upper and lower end wherein said lower end is attached to said crank;

(3) a cable block located within the hollow space of said center pole, having a hole therein, and being attached to said upper end of said crank cable;

(4) a number of screen cables corresponding to the number of ribs of said frame, each screen cable having a pole end and a screen end such that the said pole end is affixed to said center pole between the cable block and the peak of the center pole, and said screen end passes through said hole in said cable block, passes through the corresponding center pole cable guide, passes through the cable guides of the corresponding rib and is attached to a point on the lower edge of the corresponding screened panel;

whereby turning the crank in one direction lowers the screen panels and turning the crank in the other direction raises the screen panels.

2. The combination umbrella and gazebo of claim 1 wherein said ribs are hollow and wherein each screen cable passes through the proximal rib cable guide, the interior of the rib, and the distal rib cable guide.

3. The combination umbrella and gazebo of claim 1 wherein the cable block is a metal ring.

4. The combination umbrella and gazebo of claim 1 wherein the cable block is a pulley.

5. The combination umbrella and gazebo of claim 1 wherein the number of center pole screen cable guides is half the number of frame ribs, the center pole screen cable guides are evenly oriented and aligned between adjacent pairs of ribs, and the two screen cables for each pair of adjacent ribs passes through the center pole screen cable guide that is between them.

6. In a combination umbrella and gazebo comprising:

(a) a frame comprising a plurality of ribs having cable guides therein and a hollow center pole having a peak and a plurality of cable guides proximal to the peak;

(b) a canopy affixed to said frame and having a periphery;

(c) a plurality of substantially rectangular screened side panels, each panel having an upper edge, a lower edge and two side edges, each panel being attached by its upper edge to the periphery of said canopy and being attached by its side edges to the adjacent panel; and (d) a mechanism for raising and lowering the screened side panels, the improvement wherein the mechanism is a crank assembly comprising:

(1) a crank attached to said center pole;

(2) a crank cable located within the hollow space of said center pole and having an upper and lower end wherein said lower end is attached to said crank;

(3) a cable block located within the hollow space of said center pole, having a hole therein, and being attached to said upper end of said crank cable;

(4) a number of screen cables corresponding to the number of ribs of said frame, each screen cable having a pole end and a screen end such that the said pole end is affixed to said center pole between the cable block and the peak of the center pole, and said screen end passes through said hole in said cable block, passes through the corresponding center pole cable guide, passes through the cable guides of the corresponding rib and is attached to a point on the lower edge of the corresponding screened panel;

whereby turning the crank in one direction lowers the screen panels and turning the crank in the other direction raises the screen panels.

7. The combination umbrella and gazebo of claim 6 wherein the cable block is a metal ring.

8. The combination umbrella and gazebo of claim 6 wherein the cable block is a pulley.

9. A combination umbrella and gazebo comprising:

(a) a frame having a hollow center pole with an upper end and screen cable guides, and a collar slideably mounted around said center pole said collar having a position of maximum upward travel;

(b) a plurality of ribs pivotably mounted substantially at the upper end of said pole such that said ribs extend radially outward from said pole, said ribs having screen cable guides;

(c) a plurality of pivot arms having two ends and being attached at one end to said ribs and at the other end to said collar such that the ribs extend outwardly or inwardly as said collar is moved up or down said center pole;

(d) a canopy affixed to said ribs of said frame, said canopy having a periphery and having an open position and a closed position, said canopy having screening substantially along its periphery, said screening having an upper and a lower circumference;

(e) a first crank assembly affixed to said pole and enabled to raise and lower said collar, thereby moving said canopy to an open or closed position; and (f) a second crank assembly comprising:

i) a crank handle affixed to the exterior of said center pole;

ii) a shaft attached thereto within the hollow space of said center pole;

iii) a crank cable located within the hollow space of said center pole having an upper and lower end wherein said lower end is attached to said shaft;

iv) a cable block having a hole, being located within the hollow space of said center pole, and being attached to said upper end of said second crank cable; and v) a number of screen cables corresponding to the number of ribs of said frame and each having a pole end and a screen end such that the said pole end is affixed to said center pole between said cable block and the peak of said center pole, and said screen end passes through said hole in said cable block toward the upper end of said center pole, passes through the corresponding center pole screen cable guide, passes through the corresponding rib screen cable guides, and is attached to a point on the lower circumference of said screening;

whereby turning said handle in one direction causes said crank cable to wind around said shaft thereby pulling said cable block downward and resulting in the retraction of said screen cables, thereby raising said screening; and whereby turning said handle in the opposite direction causes said crank cable to unwind from said shaft, thereby allowing said cable block to move upward resulting in the extension of said screen cables, thereby lowering said screening.

10. The combination umbrella and gazebo of claim 9 wherein said ribs are hollow and have a proximal cable guide substantially adjacent the center pole and a distal cable guide substantially adjacent the periphery of the canopy and wherein each screen cable passes through the proximal cable guide, the interior of the rib, and the distal cable guide.

11. The combination umbrella and gazebo of claim 9 wherein the cable block is a metal ring.

12. The combination umbrella and gazebo of claim 9 wherein the cable block is a pulley.

13. The combination umbrella and gazebo of claim 9 wherein the number of center pole screen cable guides is half the number of frame ribs, the center pole screen cable guides are evenly oriented and aligned between adjacent pairs of ribs, and the two screen cables for each pair of adjacent ribs passes through the center pole screen cable guide that is between them.

14. The combination umbrella and gazebo of claim 9 wherein the first crank assembly comprises;

i) a first crank handle affixed to the exterior of said center pole;

ii) a first shaft attached thereto within the hollow space of said center pole;

iii) an umbrella pulley affixed to said center pole above said position of maximum upward travel of the collar; and iv) a first crank cable having two ends wherein one end of said cable is affixed to said first shaft and the other end is threaded around said umbrella pulley and affixed to said collar;

v) whereby turning the first crank handle in one direction causes said first crank cable to wind around said first shaft thereby raising said collar and opening said canopy and turning the first crank handle in the opposite direction causes said first crank cable to unwind from said first shaft thereby lowering said collar and closing said canopy.

* * * * *